US010139120B1

(12) United States Patent
Thomas, Jr. et al.

(10) Patent No.: US 10,139,120 B1
(45) Date of Patent: Nov. 27, 2018

(54) INTEGRATED VENTURI HEATING ELEMENTS FOR AIR CURTAINS

(71) Applicants: Philip M Thomas, Jr., Cranberry Township, PA (US); David A Johnson, New Castle, PA (US)

(72) Inventors: Philip M Thomas, Jr., Cranberry Township, PA (US); David A Johnson, New Castle, PA (US)

( * ) Notice: Subject to any disclaimer, the term of this patent is extended or adjusted under 35 U.S.C. 154(b) by 182 days.

(21) Appl. No.: 15/229,500

(22) Filed: Aug. 5, 2016

(51) Int. Cl.
*F24H 3/02* (2006.01)
*F24F 9/00* (2006.01)
*H05B 3/00* (2006.01)

(52) U.S. Cl.
CPC ..... *F24F 9/00* (2013.01); *H05B 3/00* (2013.01); *F24F 2221/34* (2013.01); *H05B 2203/022* (2013.01)

(58) Field of Classification Search
None
See application file for complete search history.

(56) References Cited

U.S. PATENT DOCUMENTS 1,723,405 A * 8/1929 Carmean ..... F24H 3/0417 392/361
3,211,891 A * 10/1965 Kendall ..... F24H 3/0405 338/280
3,332,334 A * 7/1967 Melzer ..... F24F 9/00 454/188
3,827,862 A * 8/1974 Berlant ..... A61L 9/20 422/121
4,090,061 A * 5/1978 Glucksman ..... F24H 3/0405 338/294
4,450,755 A * 5/1984 Catan ..... F04D 17/04 415/204
4,526,510 A * 7/1985 Hoffman ..... F23C 9/00 415/175
4,988,847 A 1/1991 Argos et al.
5,072,658 A * 12/1991 Bogage ..... F24F 9/00 454/188
5,984,649 A 11/1999 Kato et al.
7,168,917 B2 * 1/2007 Bronaugh ..... F24H 3/0405 415/177
8,568,210 B1 10/2013 Thomas, Jr. et al.

* cited by examiner

*Primary Examiner* — Thor Campbell
(74) *Attorney, Agent, or Firm* — Harpman & Harpman

(57) ABSTRACT

An air curtain resistant heating system including multiple independent heating coils integrated on blower housing. The multiple heating coils defining a pre-inflow venturi air pattern for increased heat transfer before fan cage internal flow vortex dependent on housing cage opposed openings. Coil orientation placement assures limited impact to effect blower pressure and therefore minimizes loss of air performance parameters while heating air flow in a pre-inflow venturi air pattern. Multiple phase electrical supply for multiple paired heating coils positioned in corresponding multiple blower fan units in an air curtain assembly.

1 Claim, 6 Drawing Sheets

INTEGRATED VENTURI HEATING ELEMENTS FOR AIR CURTAINS

BACKGROUND OF THE INVENTION

1. Technical Field

This invention relates to the field of air curtains used to create an airflow defined barrier in openings in buildings between interior and exterior or different conditioned spaces within the building for reduced energy use by environmental retention therebetween.

2. Description of Prior Art

Prior art devices of this type have been directed towards air curtains and associated air blower assemblies that include airstream conditioning such as heating. Typically, air curtains are limited to ambient air recirculation with the inclusion of heaters to condition the airflow as it leaves the blower through a directional outlet nozzle to form a laminar airflow barrier between openings. All known air curtain configurations condition the airflow pre or post blower, see for example U.S. Pat. No. 5,984,649.

Other heated air blower units have been developed for a variety of air heating applications with associated electric resistant coils, see for example U.S. Pat. No. 4,988,847 for defogging a bathroom mirror and well know portable electric heaters used for auxiliary point of use heating too numerous to list.

SUMMARY OF THE INVENTION

An air curtain unit with multiple blower fans having integrated heating coils positioned within and without intake air stream venturies defined by the interior of the impellor fan cage as such the heating coils conform to and define a venturi airflow characteristic by integrated coil dimension augmentation for maximum heat transfer from respective opposing heat coil placements with minimal air outflow impact.

DETAILED DESCRIPTION OF THE INVENTION

Figure 1:
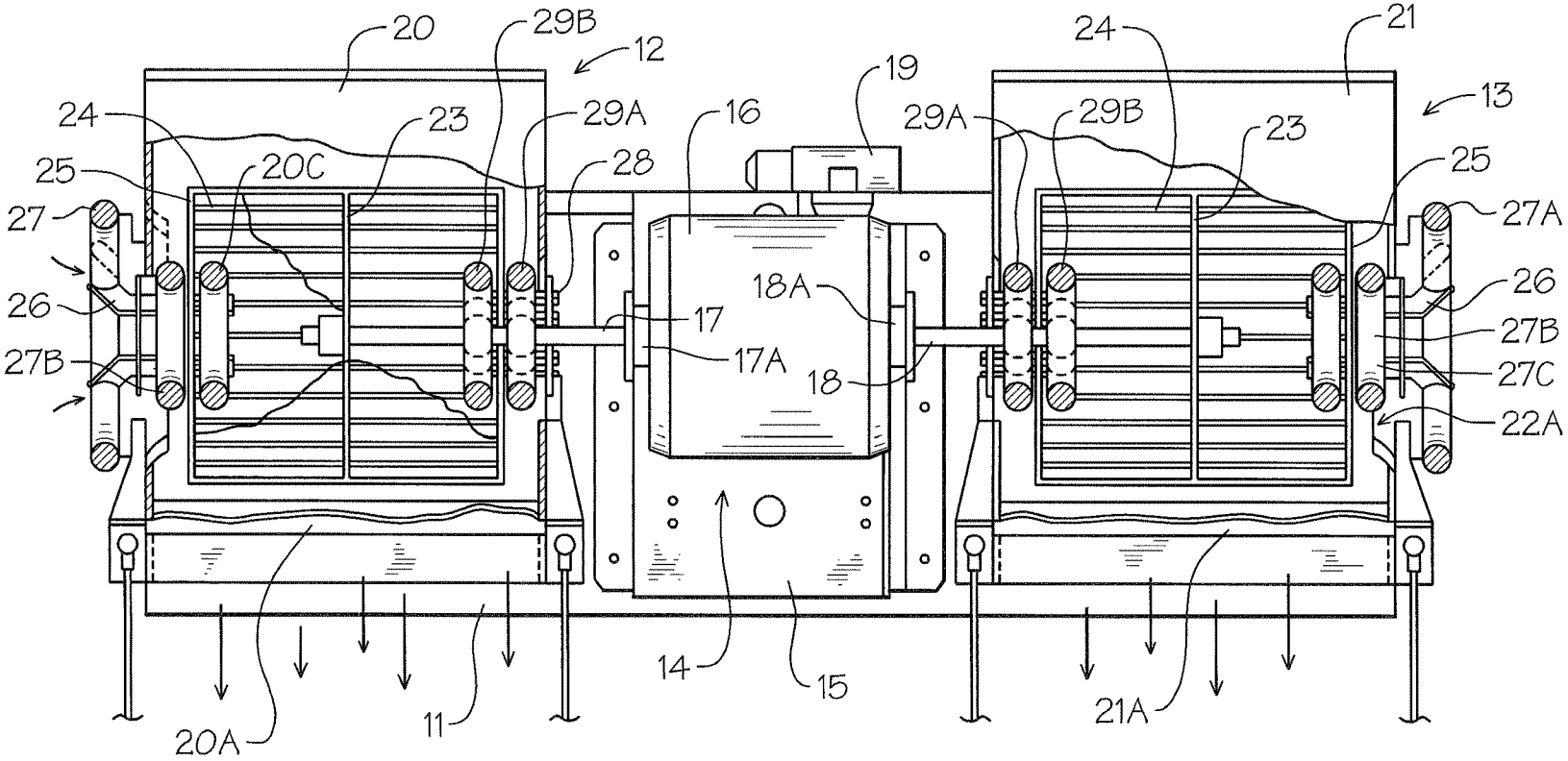
FIG. 1 is a front top elevational view of the air curtain heating system of the invention with portions cut away.

Referring to FIG. 1 of the drawings, an air curtain assembly 10 of the invention can be seen having a generally rectangular support pan 11 with a pair of air blower assemblies 12 and 13 positioned thereon in opposing aligned relation to one another. The air blower assemblies 12 and 13 are identical with an interconnected drive electric motor assembly 14 mounted therebetween for bi-directional driving as will be explained in detail hereinafter.

The electric motor assembly 14 has an upstanding motor support frame mount 15 with an electric drive motor 16 mounted thereon. The drive motor 16 has a pair of oppositely disposed extending power drive shafts 17 and 18 with respective associated bearing assemblies 17A and 18A and a power controller 19 as is well known and understood within the art. The power controller 19 is in electrical communication with a power supply motor control circuit C well known and understood within the art in such industrial applications.

Figure 2:
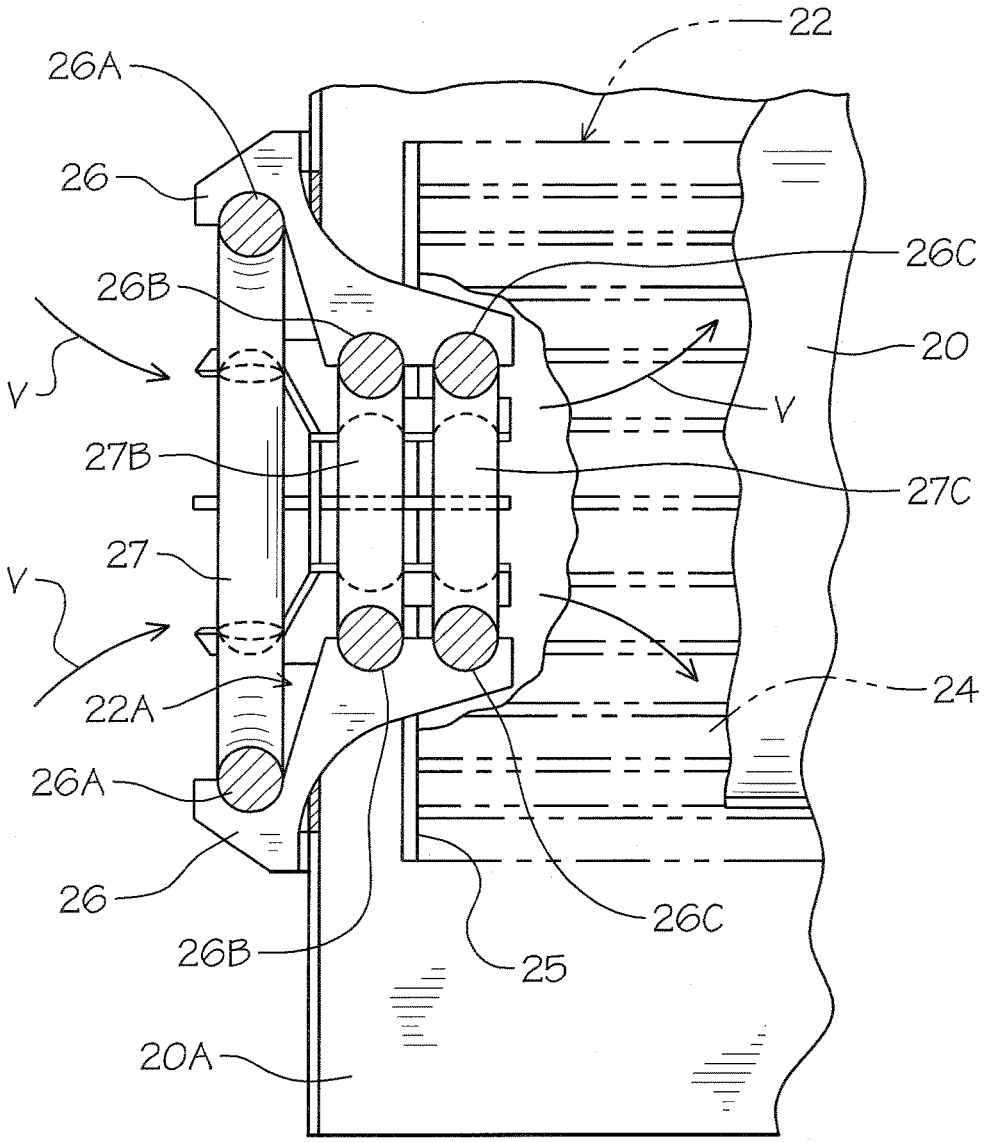
FIG. 2 is an enlarged side elevational view with portions cut away.

As noted, each of the blower assemblies 12 and 13 are identical having a blower housing cylindrical casings 20 and 21 with integrated rectangular extending nozzle outlets 20A and 21A formed thereon secured to the support pan 11, as best seen in FIG. 2 of the drawings. Each air blower has a fan cage 22 supported in rotational relationship therewithin on corresponding respective free ends of the drive shafts 17 and 18 by a central impellor mounting disk 23. Each fan cage 22 comprises a plurality of cross-sectionally contoured impellor blades 24 which are supported, as noted, by the central mounting disk 23 registering annularly thereabout and respective oppositely disposed annular cage end impellor support rings 25 for engagement and support of the corresponding parallel annularly spaced multiple contoured impellor blades 24 fabricated by typical manufacturing methods well known within the art.

Figure 3:
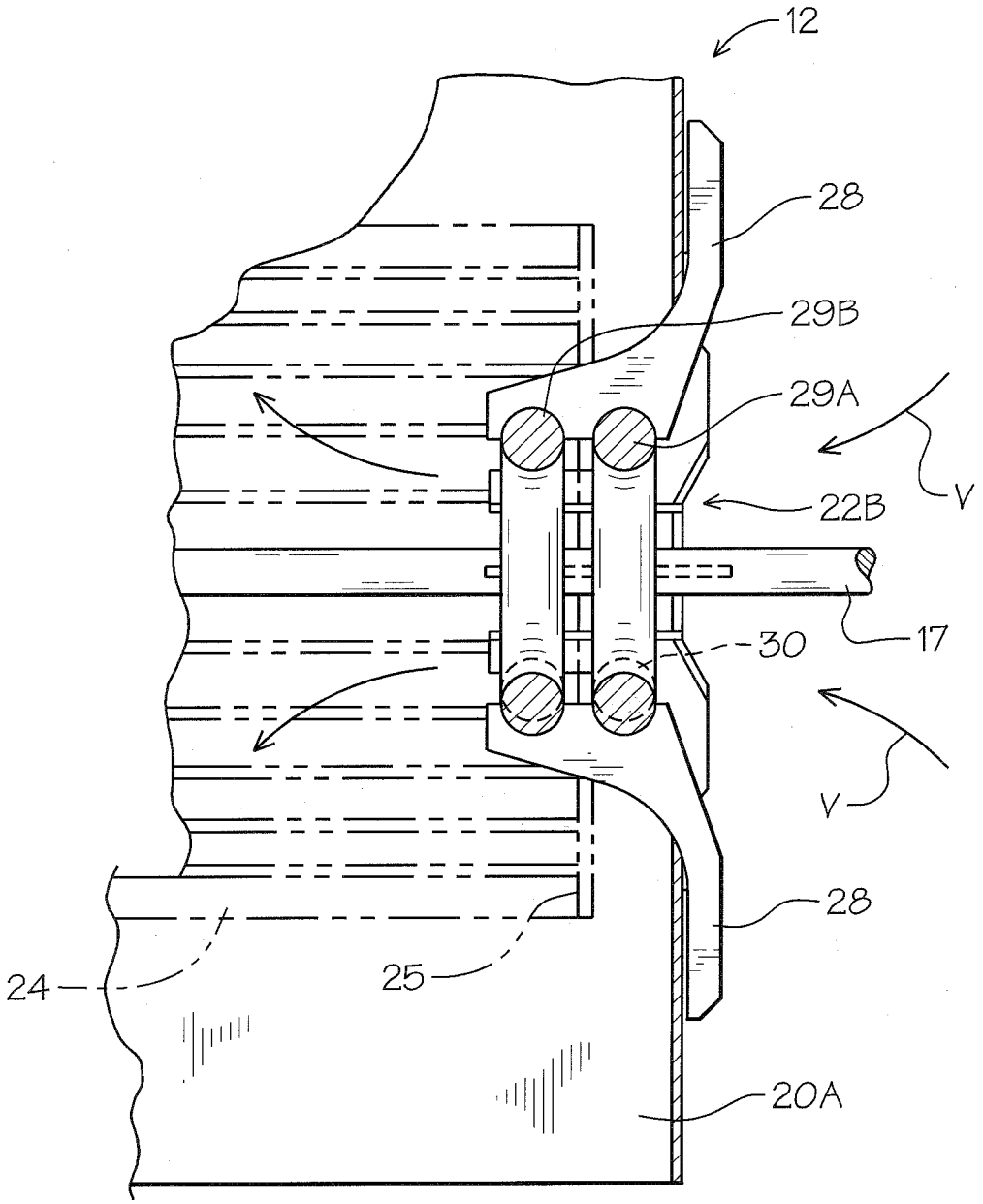
FIG. 3 is an enlarged partial side elevational view with portions cut away of an outer heating coil assembly positioned within the fan cage.
Figure 4:
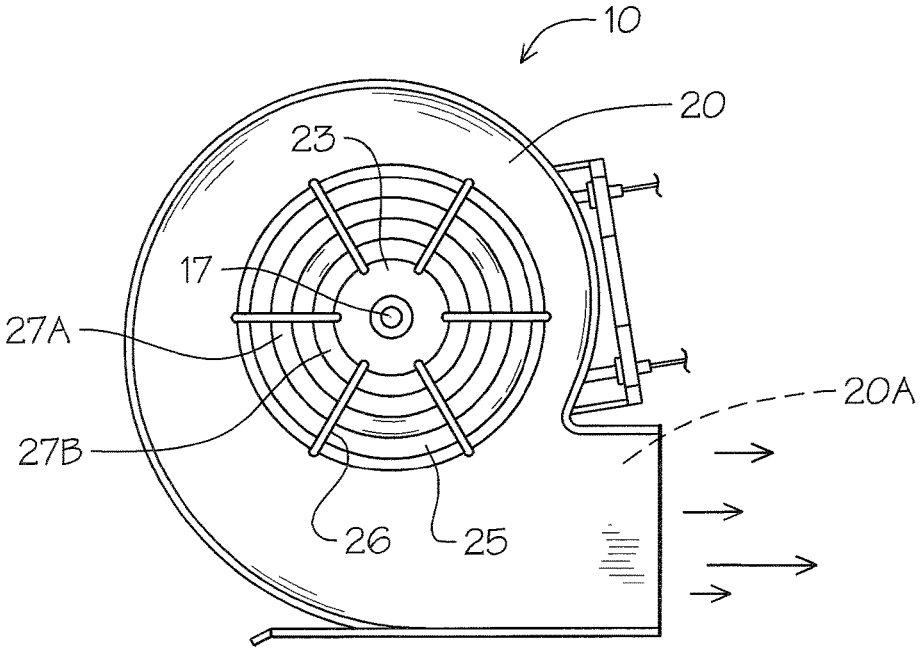
FIG. 4 is an enlarged partial end elevational view thereof.

Outer end multiple heating coil mounting heating coil mounting brackets 26, best seen in FIGS. 1, 2 and 3 of the drawings are fitted within respective open ends 22A of the fan cages 22.

The mounting brackets 26 support multiple annular spaced coil engagement elements 27, each bracket having multiple half arcuate coil receiving notches 26A, 26B and 26C therewithin. The mounting brackets 26 extend from outside the impellor's fan cage 22 inwardly holding the assistant heating coils 27A, 27B and 27C of different annular dimensions.

In this example, the coils 27B and 27C are of identical dimension with coil 27A of an increased diameter dimension so as to form a venturi shaped air intake flow V (illustrated by flow arrows) feeding into and within the fan cages 22 during operational rotation by the drive shafts 17 and 18 as hereinbefore described.

Referring now to FIG. 3 of the drawings, the "inner" inside end mounting coil configuration can be seen on the blower assembly 12 wherein modified coil mounting brackets 28 are positioned in spaced annular relation to mount respective split heating coils 29A and 29B inside the respective cage ends 22B facing the aforedescribed drive motor 16. The heating coils 29A and 29B are split with a gap at 30 allowing insertion and removal around the respective drive shaft extensions 17 and 18 passing through the center of the coils to the central mounting disks 23 on the drive shaft's respective free ends and the electric motor 16, as noted. Given the reduced coil diameter of the inside end coils 29A and 29B so positioned within the respective cage ends 22B, a venturi shaped inflow airstream V is also created therewithin with the associated enhanced efficiency and economy of co-laminar airflow over the coils for maximum heat transfer within the cage ends 22B.

Figure 5:
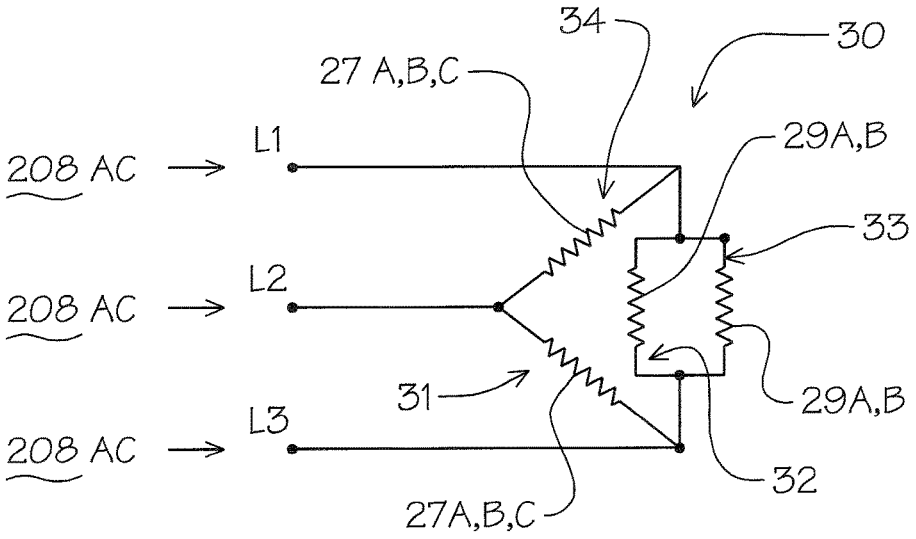
FIG. 5 is a graphic illustration of the three phase power supply circuit associated with the energization of the multiple heating coil assemblies therewith.

Referring now to FIG. 5 of the drawings, an electrical supply coil energizing circuit 31 is graphically illustrated for distributing measured equal power supply to the multiple heating coils defined for clarity as outside coil assemblies 31 and 34 and corresponding inner heating coil assemblies 32 and 33 shown graphically. As noted, each of the heating coil assemblies 31, 32, 33 and 34 have multiple coils hereinbefore described as outside coil element pairs 27A, 27B, 27C and inside coil element pairs 29A and 29B within respective coil assemblies 31 and 34 and 32 and 33 noted.

It will be seen when a three phase commercial power source is used defined in the graphic electrical supply circuit 31 as L1, L2 and L3, in this example, 208 volts of the outside coil pair assemblies 31 and 34 are supplied by L2 at approximately 4.66 kw each and the inside coil pair coil assemblies 32 and 33 are supplied in parallel at 2.33 kw each, thus defining an equal power supply of 4.66 kw for each coil configuration as will be understood by those skilled in the art.

Figure 6:
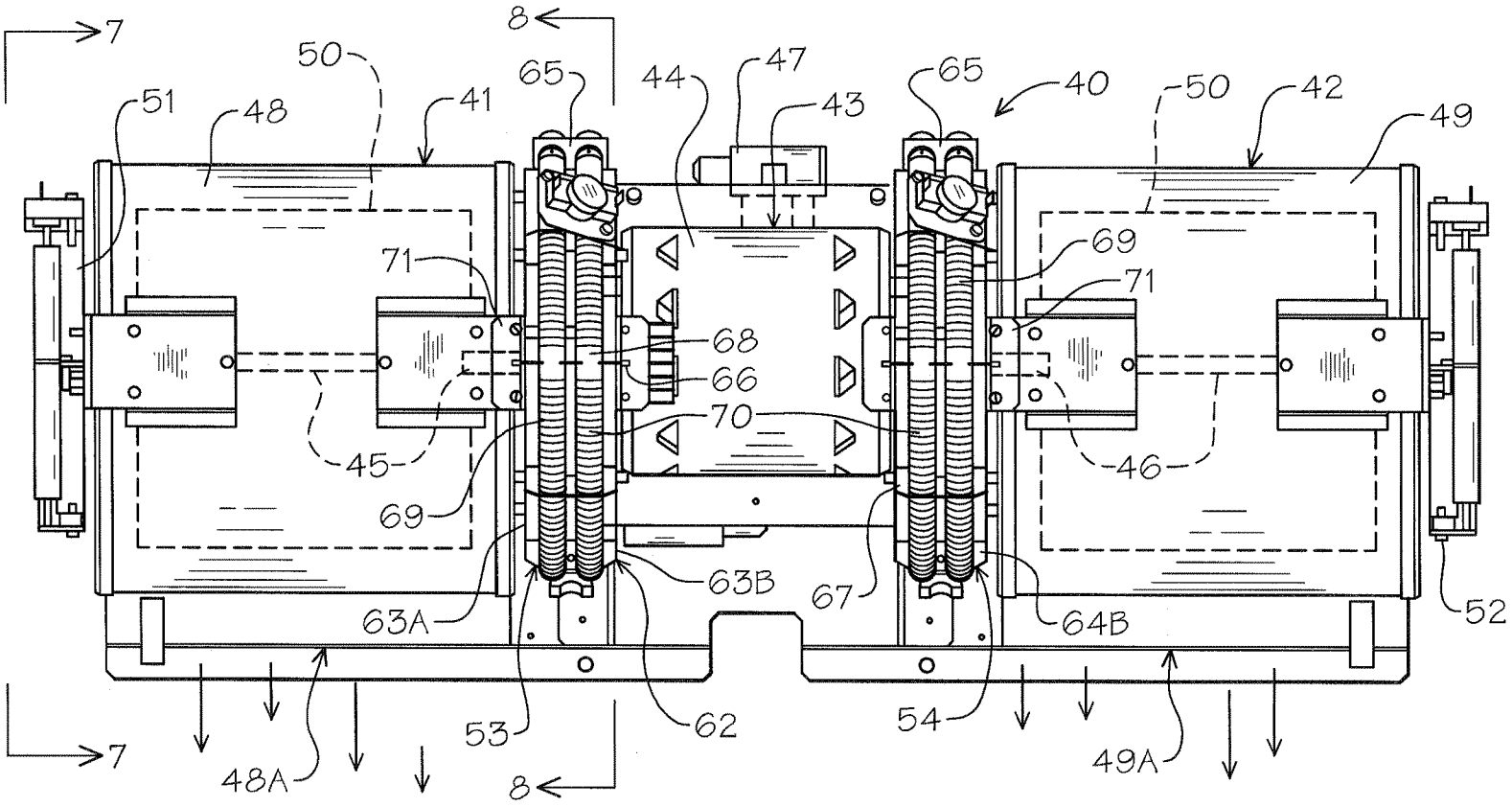
FIG. 6 is a top elevational view of an alternate air curtain heating coil orientation of the invention.
Figure 8:
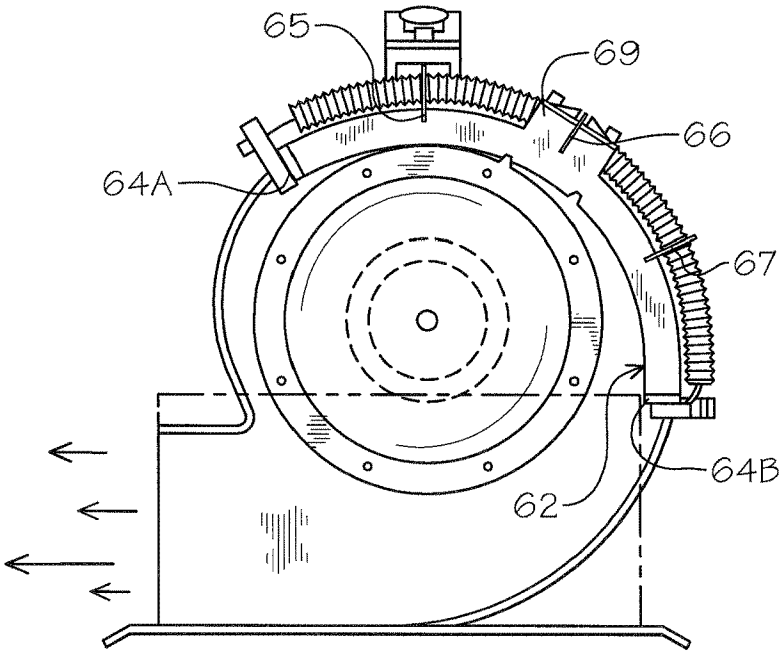
FIG. 8 is an enlarged right end elevational view on lines 8-8 of FIG. 6 illustrating the heating coil position thereof.
Figure 7:
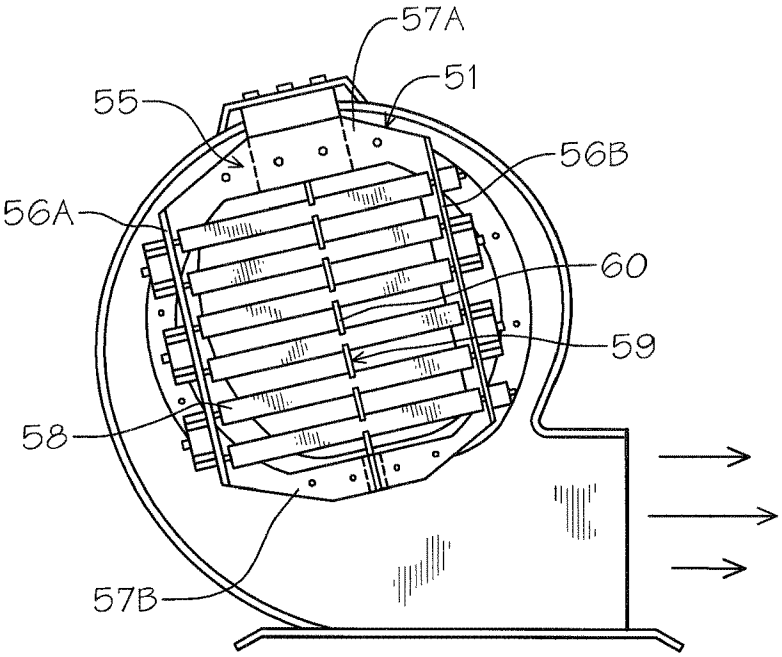
FIG. 7 is an enlarged left end elevational view on lines 7-7 of FIG. 6 illustrating the heating coil position thereof.

Referring now to FIGS. 6, 7 and 8 of the drawings, alternate heating coil arrangements 40 can be seen having a pair of identical blower assemblies 41 and 42 with interconnected electrical motor drive assembly 43 positioned therebetween as found in the hereinbefore described primary form of the invention's air blower assemblies 12 and 13 and motor assembly 14.

A drive motor 44 has a pair of oppositely disposed extending drive shafts 45 and 46, shown in broken lines, and a power controller 47 in electrical communication with the power supply motor control circuit C as hereinbefore discussed in the primary form of the invention 10, as noted. The identical blower assemblies 41 and 42 have respective blower housing cylindrical casings 48 and 49 with integrated rectangular extending nozzle outlets 48A and 49A formed thereon.

Each air blower has a fan cage 50 supported in rotational relationship therewithin.

The alternate heating coil assemblies 40 are defined by a pair of modified outer blower end coil mounting brackets 51 and 52 and a pair of modified oppositely disposed inner blower end coil mounting assemblies 53 and 54, best seen in FIGS. 6, 7 and 8 of the drawings.

The outer mounting brackets 51 and 52 each have a coil support frame 55 having spaced parallel coil end engagement flanges 56A and 56B interconnected by top and bottom cross members 57A and 57B best seen in FIG. 7 of the drawings.

A plurality of cylinder resistant heating coils 58 extend between the engagement flanges 56A and 56B in parallel aligned spaced relation to one another. A central coil support element 59 extends between the respective cross members 57A and 57B with coil stabilization and engagement arms 60 extending therefrom.

It will be evident from the above description that the combination of the end supported cylindrical resistant heating coils 58 with the center coil support element 59 provides a stabile and incrementally equally spaced coil arrangement which is critical to the pre-vortex air flow configuration as will be described in greater detail hereinafter.

Coil end power connection fittings 61 are fitted to the respective ends of each resistant coil 58 for selective interface with a power circuit C as hereinbefore described.

A support flange mount 61 extends from the top member 57A overlying and secured to the exterior surface of the blower cylindrical casings 48 and 49 respectively.

Referring now to FIGS. 6 and 8 of the drawings, the inner blower end coil mounting assemblies 53 and 54 can be seen having a contoured arcuate frame 62 with spaced opposing sides 63A and 63B interconnected by respective ends 64A and 64B. Multiple intermediate coil support cross braces 65, 66 and 67 extend and are secured between the sides 63A and 63B dividing the frame into four equal arcuate sections.

Each of the cross brackets 65-67 have a coil wire registration notch 68 therein to engage support and positionally separate a pair of resistant heating coils 69 and 70 which are held within the frame 62 in a corresponding arcuate delineation. The mounting assemblies 53 and 54 are secured to the respective blower cylinder casings 48 and 49 by a flange bracket 71 which overlies and is secured thereto.

It will be evident from the above description that the outside respective ends of the cylindrical casings 48 and 49 will still provide a blower air intake path that will emulate a venturi intake effect while achieving ease of insulation and service. The orientation and positioning of the respective heating coil assemblies 40 externally as hereinbefore described effectively define a pre-venturi air intake path insuring an effective and efficient heating of the air flow as it enters the respective blowers of a so defined air curtain assembly as previously described generally known within the art.

It will be evident that the hereinbefore described integrated inner venturi heaters for air curtains provides a unique combination of integrated fan inclusively positioned airflow determinate heating coil assemblies in the respective ends and about the corresponding impellor fan cages of blower assembly used within an air curtain configuration to impart a modified venturi air intake effect over the respective heating coil surfaces both internally and externally in the alternate coil forms for increased efficiency and enhanced heat transfer with the utilization of a unique three power phase supply electrical energy distribution into corresponding four coil assembly use of equal power intake available only in the configuration set forth in the above referred to description and embodiment.

It will thus be evident that a new and novel air curtain venturi integrated heater coil configurations have been illustrated and described and it will be apparent to those skilled in the art that various changes and modifications may be made therein without departing from the spirit of the invention.

Therefore, we claim:

1. Integrated heating coil units for an air curtain comprises, an air curtain having a plurality of blower units, each blower unit having an axle impellor cage driven by a single electric motor there between, a housing for each of said impellor cage defining a directional nozzle outlet, oppositely disposed equilateral air inlets in said housing aligned with said respective impellor cages, said integrated heating coil units comprises, first heating coil assemblies overlying one of said air inlets in each of said housings having a coil support frame with spaced parallel coil end engagement flanges, interconnected top and bottom cross members, a coil mounting bracket extending from said cross member secured to said housing for each of said impellor cages wherein said heating coil assemblies are powered by a power supply through a power distribution energizing circuit balance power distribution to respective coil pairs in parallel power orientation therewith, second heating coil assemblies positioned partially around the perimeter of said remaining air intakes in each of said housings so that said first and second heating coil assemblies receive inlet air flow directly there through.

* * * * *